United States Patent [19]

Urani

[11] 4,391,485

[45] Jul. 5, 1983

[54] IN-LINE FUSE HOLDER FOR MINIATURE PLUG-IN FUSE

[75] Inventor: Angelo Urani, St. Louis, Mo.

[73] Assignee: McGraw-Edison Company, Rolling Meadows, Ill.

[21] Appl. No.: 223,893

[22] Filed: Jan. 9, 1981

[51] Int. Cl.[3] ..... H01R 13/115; H01R 19/48

[52] U.S. Cl. ..... 339/191 S; 337/198; 337/201; 337/215; 339/147 R; 339/259 F

[58] Field of Search ..... 339/256 C, 258 F, 259 F, 339/147 R, 147 P, 191 R, 191 S; 337/187, 188, 197, 198, 201, 215, 245

[56] References Cited

U.S. PATENT DOCUMENTS

| | | | |
|---|---|---|---|
| 976,532 | 11/1910 | Wirt | 337/215 |
| 1,122,754 | 12/1914 | Hooker | 339/259 F |
| 1,486,791 | 3/1924 | Nutt | 339/259 F |
| 1,864,283 | 6/1932 | Steinmayer | 337/187 |
| 2,011,391 | 8/1935 | Bennett | 339/259 F |
| 2,536,520 | 1/1951 | Tighe | 337/201 |
| 2,839,636 | 6/1958 | Brown | 337/201 |
| 3,287,528 | 11/1966 | Boone | 337/195 |
| 3,843,050 | 10/1974 | Melugin | 337/213 |
| 3,909,767 | 9/1975 | Williamson et al. | 337/264 |
| 4,224,592 | 9/1980 | Urani | 337/198 |

FOREIGN PATENT DOCUMENTS

| | | | |
|---|---|---|---|
| 508278 | 12/1954 | Canada | 337/198 |
| 1126944 | 8/1956 | France | 339/259 R |
| 1322300 | 2/1963 | France | 337/198 |

*Primary Examiner*—Neil Abrams

*Attorney, Agent, or Firm*—Charles W. MacKinnon; Ronald J. LaPorte; Jon Carl Gealow

[57] ABSTRACT

An in-line fuse holder capable of handling currents as high as 30 amps, adapted to accept miniature, relatively flat, plug-in fuses which have a pair of flat terminals and a fuse link visibly retained within a relatively flat plastic case. The in-line fuse holder has a relatively rigid casing in which a pair of generally U shaped contact clip assemblies are mounted for receiving the flat terminals of the plug-in fuse. The contact clips are of two piece construction with an inner clip of highly conductive material and an outer clip of highly resilient material. The outer clip fits over the inner clip to force the inner clip into low resistance contact with the fuse terminals.

10 Claims, 7 Drawing Figures

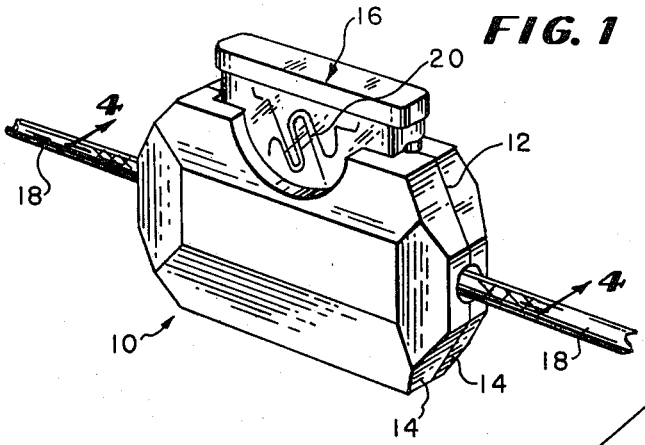
FIG. 1
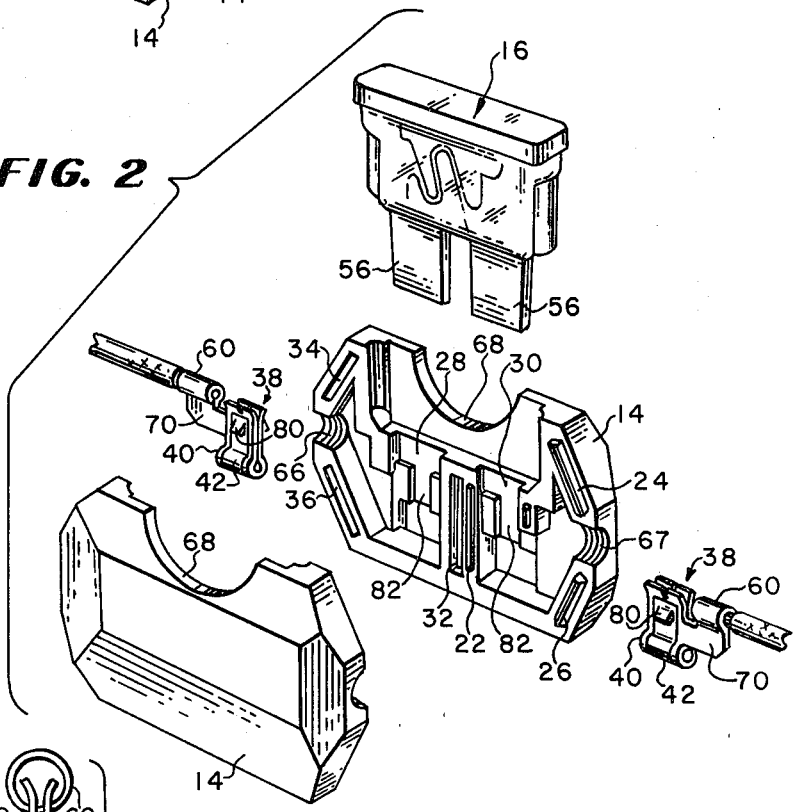
FIG. 2
FIG. 3
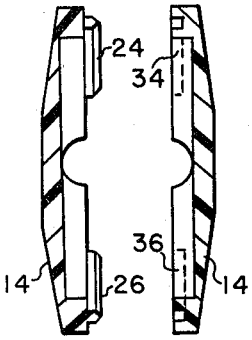
FIG 5
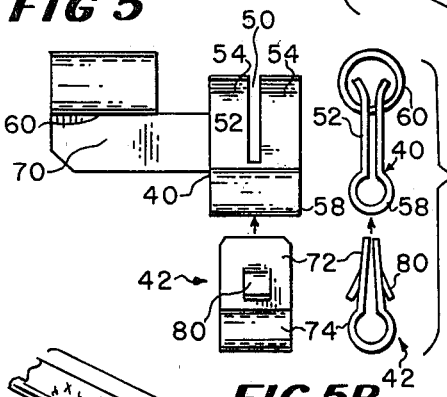
FIG. 5A
FIG. 4
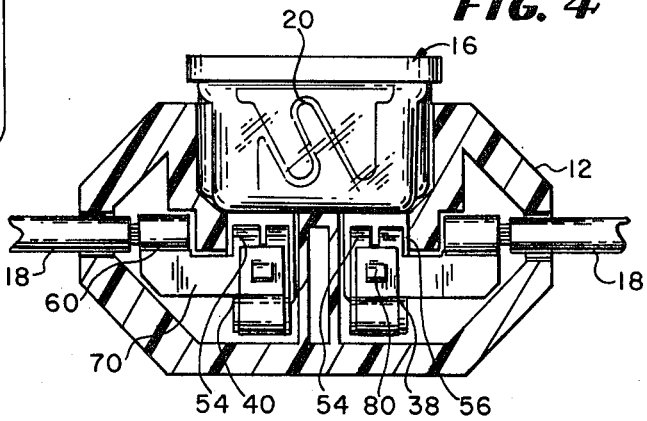
FIG.5B
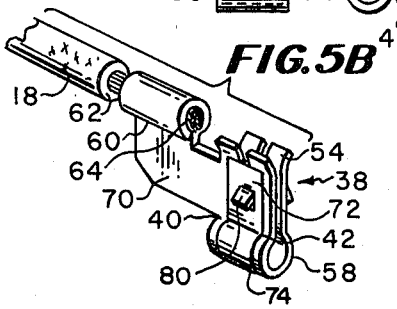

IN-LINE FUSE HOLDER FOR MINIATURE PLUG-IN FUSE

BACKGROUND OF THE INVENTION

1. Field of the Invention

The present invention relates to fuse holders, and more particularly to in-line fuse holders adapted to accept miniature, relatively flat, plug-in fuses, such as those utilized in automobiles, which have a pair of flat terminals and a fuse link visibly retained within a relatively flat plastic case.

2. Description of the Prior Art

In general, it is desirable that a fuse be of the smallest physical size permitting required levels of current flow and yet assuring interruption of the flow of electrical current when required. Until recently, the most common type of fuses in the latter category were those having a sealed glass cylindrical envelope surrounding a fusible link electrically connected at opposite ends to terminal connectors capping each end of the glass envelope. This type of fuse has been used extensively in automobiles. Such a fuse, however, suffers the disadvantages of being bulky, fragile, somewhat difficult to handle, and having terminals exposed to undesired contact.

In an attempt to eliminate or overcome many of the drawbacks of the glass encapsulated type of fuse, a miniature plug-in fuse was developed which includes a pair of flat, terminals and a fuse link extending therebetween visibly retained within a transparent insulative plastic casing. The casing is relatively flat and the terminals are co-planar and protrude from one edge of the casing. Examples of this type of fuse are illustrated in U.S. Pat. No. 4,224,592-Urani & Gaia, assigned to the same assignee as the present invention, and those disclosed in U.S. Pat. No. 3,909,767-Williamson et al.

As the use of these miniature fuses has increased, the need for fuse holders which can accommodate them has similarly expanded. One of the most common types of fuse holders employed in the automotive industry and, in other industries as well, is the in-line fuse holder. Presently, the most common type of in-line fuse holder which accommodates miniature flat plug-in fuses includes a one-piece molded, soft plastic housing and single piece clip contacts for connection to the fuse terminals and to leads for external connection of the fuse holder. An example of such fuse holder is the Model 100, produced by Triplex Mfg. Company.

Construction of an in-line fuse holder with clip contacts of the aforementioned type limits material selection for such clip contacts to those materials having both good electrical conductivity to minimize resistive heating and good tensile strength to supply a tight electrical connection with the fuse terminals and to reduce contact resistance. However, even with the best material selection, compromises in both conductivity and tensile strength qualities must be made in order to achieve certain minimum qualities of both characteristics in one material. In addition, the use of soft plastic material to form the fuse holder housing provides little, if any assistance to the clip contacts in gripping the fuse terminals. The result is that because of the limited contact area of the terminals of the afore-mentioned miniature, plug-in fuses, the current carrying capacity of the fuse holder clips is restricted normally to 20 amps or less. However, the miniature plug-in fuses designed for use with these in-line fuse holders are available in current ratings as high as 30 amps. In addition, many modern automotive accessories and other products with low voltage power requirements also demand higher currents, often over 20 amps at these lower voltages.

SUMMARY OF THE INVENTION

Accordingly, it is a primary object of the present invention to provide an in-line fuse holder for use with miniature, plug-in fuses of the type heretofore described which overcomes the drawbacks of prior art in-line fuse holders designed to receive such plug-in fuses and having the capability of accommodating fuses with relatively high current ratings.

It is another object of the present invention to provide an in-line fuse holder of the last mentioned type which is simple in construction, relatively low in cost and effective in use.

Briefly a preferred embodiment of an in-line fuse holder for use with miniature a plug-in fuses according to the invention, includes a relatively rigid, insulative outer housing or casing in which a pair of generally U shaped contact clip assemblies are mounted for receiving the flat, co-planar terminals of a plug-in fuse. The contact clips are of two piece construction having an inner clip formed preferably of copper and an outer clip formed preferably of spring steel.

The copper, inner clip includes a pair of generally flat clip blades which make electrical contact with the flat, terminal of a plug-in fuse. Each clip blade is slotted to form four fingers for greater contact engagement of the fuse terminals received therein and also allow for greater flexibility of the blades. In addition, each copper inner clip includes a barrel terminal extending from the open edge of one of the clip fingers for connection to the incoming wire lead for external electrical connection of the fuse holder. The copper material provides high conductivity and yet is sufficiently ductile to lend itself to crimping in the case where the barrel terminal is coupled to an incoming wire lead. In addition, the clip blade design provides sufficient mass for carrying high currents.

The spring steel outer clip provides high tensile strength to force the copper fingers of the inner clip blades into a low resistance contact with the fuse terminal. Tangs formed on the spring steel outer clip extend outwardly from the flat surface of the spring steel clip. When the fuse clips are installed within the rigid insulative casing, the tangs produce pressure between the casing walls, the clip fingers of the copper inner clip and the fuse terminals. The tangs also serve as a means of retaining the fuse clip assembly securely in place within the rigid insulative casing.

The outer casing employed with the fuse clip assembly is designed to handle incoming electrical leads of up to size #10 wire and yet be of a relatively compact size. The casing is also designed to permit a visual determination of a blown fuse without removal of the fuse from the fuse holder and in addition allows one to firmly grip the installed fuse for removal.

DESCRIPTION OF THE DRAWINGS

In the drawings:

FIG. 1 is a perspective view of an in-line fuse holder according to the invention shown with a miniature plug-in fuse inserted thereinto;

FIG. 2 is an exploded perspective view of the in-line fuse holder and miniature plug-in fuse of FIG. 1;

FIG. 3 is an exploded end view of the casing of the fuse holder of FIG. 1;

FIG. 4 is a cross-sectional view of the fuse holder of FIG. 1 taken along line 4—4;

FIG. 5 is an exploded side view of a contact clip assembly included in the in-line fuse holder according to the invention;

FIG. 5*a* is an end view of the contact clip assembly of FIG. 5; and

FIG. 5*b* is an enlarged perspective view of the contact assembly of FIG. 2 shown in an assembled condition.

DETAILED DESCRIPTION OF PREFERRED EMBODIMENT

Referring now to the drawings in greater detail wherein like numerals have been employed throughout the various views to designate similar components, FIG. 1 shows a preferred embodiment of an in-line fuse holder 10 according to the invention including a fully inserted miniature plug-in fuse 16. The in-line fuse holder 10 is connected into a circuit by incoming wires 18 which place the fuse holder in series connection, for example, between an automotive battery or power supply (not shown) and an electrical accessory (not shown) requiring overcurrent protection. It can be seen in FIG. 1 that even with miniature plug-in fuse 16 inserted fully into in-line fuse holder 10, fusible element 20 of miniature plug-in fuse 16 remains clearly visible as an indication of fuse condition.

Fuse holder 10 includes two fuse clip assemblies 38 and an outer casing or housing 12 comprising two identical casing halves 14 formed of rigid, insulative plastic or the like material. Each casing half 14 includes predeterminedly shaped ridges 22, 24 and 26, respectively, and grooves or recesses 32, 34 and 36, respectively, formed at predetermined locations. When the casing halves 14 are placed back to back, ridges 22, 24 and 26 of one half are aligned with grooves 32, 34, and 36, respectively, of the other half for mating engagement thereby to form a complete casing 12. The casing halves are retained in a joined condition by sonic welding, gluing or the like. Each casing half 14 further includes a cutout 68 formed along the top thereof to allow for easy visual inspection of the condition of fuse 16, recesses 66 and 67 which permit the passage of wires 18 from the inside to the outside of an assembled casing 12, and recesses 28 and 30 for receipt of clip assemblies 38 when casing halves are assembled into a complete casing 12.

Referring to FIGS. 5, 5*a* and 5*b*, it can be seen that each clip assembly 38 comprises a generally U shaped inner clip 40 and generally U shaped outer clip 42. The inner clip 40 is fabricated of a conductive material, preferably copper. Inner clip 40 includes blades 52 forming the legs of the U and an enlarged base portion 58 forming the base of the U. The blades 52 are parallel to and in direct contacting engagement with fuse terminals 56. Blades 52 define slots 50 which provide four fingers 54 thereby to increase contact engagement with the fuse terminals 56 of fuse 16 and also to provide greater flexibility of blades 52.

Each copper inner clip 40 is formed with a barrel terminal 60, shaped to accommodate incoming wires 18 of up to size #10 wire. The insulation 62 on incoming wires 18 is stripped back, exposing bare wires 64. Barrel terminal 60 may be either crimped or soldered onto the wires 64 to make an electrical connection therewith. Barrel terminal 60 is joined to inner clip 40 by barrel terminal tab 70 extending from barrel terminal 60 to the open edge of one of fingers 54 of inner clip 40.

Outer clip 42 includes blades 72 and an enlarged base 74 structured for receipt in an overlying relation with respect to blades 52 and enlarged base portion 58 respectively, of inner clip 40, as seen in FIGS. 2 and 5*b*. Blades 72 of clip 42 force fingers 54 of inner clip 40 into tight gripping engagement and a low resistance contact with fuse terminals 56. The provision of enlarged base portion 74 produces increased retention or gripping forces to blades 72. Blades 72 of outer clip 40 also include centrally disposed tangs 80 which extend outwardly from the surface of the blades.

Preassembled and prewired clip assemblies 38 are installed into predeterminedly shaped recesses 28 and 30 of a first casing half 14 as seen in FIG. 4. When a second casing half 14 is placed in mating engagement with the first casing half 14 to form a complete casing 12, the clip assemblies are held securely in position in the resulting cavities defined by the opposing recesses. Tangs 80 of outer clips 42 press against the inner housing walls 82 of the casing halves, placing additional pressure on blades 52 to provide a positive electrical connection between clip fingers 54 of inner clip 40 and fuse terminals 56. Tangs 80 and the relatively rigid plastic casing 12 cooperate to retain clip assemblies 38 tightly in place within the fuse casing 12.

The in-line fuse holder including the contact clip assemblies 38 according to the invention is capable of handling continuous branch circuit currents of up to 30 amps which are required by many of the modern automotive accessories and other products with low voltage power requirements. Yet the fuse holder is compact in design and relatively simple in construction.

While a specific embodiment of the fuse holder according to the invention has been shown and described, it should be understood that the invention is not limited thereto since many modifications thereof may be made. It is therefore contemplated to cover by the present application any and all such modifications as fall within the true spirit and scope of the appended claims.

I claim:

1. An in-line fuse holder for receiving a miniature, plug-in fuse having a fusible element coupled between a pair of juxtaposed, laterally spaced co-planar, parallel generally flat fuse terminals, said in-line fuse holder including in combination:

a casing of insulative material having rigid wall surfaces, two clip assemblies mounted within said casing, each for engaging one of said flat fuse terminals of said plug-in fuse, each said clip assembly including first clip means of electrically conductive material, said first clip means being generally U shaped with legs of the U forming blades between which said flat fuse terminals are to be received, second clip means of resilient material, said second clip means being generally U shaped with the legs of the U forming blades and dimensioned for cooperating engagement with said first clip means in a tightly fitting overlying relationship with respect thereto, said second clip means including a tang extending outwardly from the surface of each of said blades of said second clip means for engagement with said rigid wall surfaces of said insulative casing, said tang and said rigid wall surfaces cooperating to increase the gripping force provided by said blades of said second clip means against the blades of said first clip means thereby to urge said blades of said first clip means into low electrical resistance contacting engagement with said fuse terminals and means extending from said first clip means for permanent external in-line electrical connection of said fuse holder.

2. The in-line fuse holder as recited in claim 1 wherein the base portion of the U of said first and second U shaped clip means are enlarged for transmitting increased gripping force between the blades of said first clip means and said flat fuse terminals thereby to urge said blades of said first clip means into low electrical resistance connecting engagement with said fuse terminals.

3. The in-line fuse holder as recited in claim 2 wherein said enlarged base portion of said second U shaped clip means is received in overlying relationship with respect to said enlarged base portion of said first U shaped clip means.

4. The in-line fuse holder as recited in claim 2 wherein each of said blades of said first clip means is separated into two vertical fingers extending from said enlarged base porton whereby engagement between said blades of said first clip means and said fuse terminals is insured.

5. The in-line fuse holder as recited in claim 1 wherein said means for external electrical connection of said fuse holder includes a wire having a conductive portion and surrounding insulation and a connecting tab and a barrel terminal extending from one of said blades of said first clip means, said barrel terminal being dimensioned for receipt of said conductive portion of said wire in contacting relation therewith.

6. The in-line fuse holder as recited in claim 1 wherein said insulative casing includes a cutout for viewing the condition of the fusible element of a plug-in fuse received in said fuse holder when said fuse has been fully inserted into said fuse holder.

7. The in-line fuse holder as recited in claim 1 wherein said fuse clip comprises copper and said second clip means comprises spring steel.

8. The in-line fuse holder as recited in claim 1 wherein said insulative casing includes to casing halves each of said casing halves defining raised ridges and grooves, said raised ridges of one casing half fitting into said grooves of said other casing half in mating engagement when said casing halves are aligned and joined together in back to back relation.

9. The in-line fuse holder as recited in claim 8 wherein said two casing halves are ultrasonically welded together to form said insulative casing.

10. The in-line fuse holder as recited in claim 8 wherein said two casing halves are glued together to form said insulative casing.

* * * * *